US009465336B2

(12) United States Patent
Saito et al.

(10) Patent No.: US 9,465,336 B2
(45) Date of Patent: Oct. 11, 2016

(54) CONTROL DEVICE, IMAGE FORMING APPARATUS AND FIXING DEVICE

(71) Applicant: CANON KABUSHIKI KAISHA, Tokyo (JP)

(72) Inventors: Shutaro Saito, Kashiwa (JP); Kenichi Tanaka, Abiko (JP); Taiya Hirayama, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/721,206

(22) Filed: May 26, 2015

(65) Prior Publication Data

US 2015/0346654 A1 Dec. 3, 2015

(30) Foreign Application Priority Data

May 29, 2014 (JP) ..... 2014-111044
Apr. 3, 2015 (JP) ..... 2015-076663

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC ..... G03G 15/2039; G03G 15/2053; G03G 21/20
See application file for complete search history.

(56) References Cited

U.S. PATENT DOCUMENTS 5,506,667 A * 4/1996 Kinoshita ..... G03G 15/2064 399/21
7,262,391 B2 8/2007 Nishihara et al.
7,890,024 B2 2/2011 Hirayama et al.
7,890,038 B2 2/2011 Chikugo et al.
8,655,242 B2 2/2014 Tanaka
(Continued)

FOREIGN PATENT DOCUMENTS

JP 2008-040365 2/2008
JP 2011-56945 A 3/2011
JP 2012-234016 A 11/2012

OTHER PUBLICATIONS

Taiya Hirayama et al., U.S. Appl. No. 14/721,344, filed May 26, 2015, Group 2852.
(Continued)

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

A control device configured to control an image forming apparatus by replacing a fixing device mounted therein with another fixing device including a storing portion configured to store information corresponding to a width of a recording material. The control device includes: a reading portion configured to read the information corresponding to the width of the recording material stored in the storing portion; an obtaining portion configured to obtain information corresponding to a width of a recording material to be subjected to image formation; and a controller configured to control an operation of the image forming apparatus on the basis of the information read by the reading portion and the information obtained by the obtaining portion. The controller prohibits an image forming operation when the width of the recording material obtained by the obtaining portion is smaller than the width of the recording material read by the reading portion.

65 Claims, 10 Drawing Sheets

(56) References Cited

U.S. PATENT DOCUMENTS

| | | | | |
|---|---|---|---|---|
| 8,779,335 | B2 | 7/2014 | Saito | |
| 8,942,612 | B2 | 1/2015 | Tanaka | |
| 8,958,716 | B2 | 2/2015 | Saito | |
| 9,069,299 | B2 | 6/2015 | Tanaka | |
| 2004/0047641 | A1* | 3/2004 | Kato | G03G 15/1675 399/45 |
| 2009/0252519 | A1* | 10/2009 | Yamagata | G03G 15/2042 399/68 |
| 2011/0026947 | A1* | 2/2011 | Hayamizu | G03G 15/2042 399/33 |
| 2011/0058201 | A1 | 3/2011 | Mueller | |
| 2013/0156447 | A1* | 6/2013 | Eiki | G03G 15/2078 399/33 |
| 2014/0153938 | A1 | 6/2014 | Saito | |
| 2015/0185670 | A1 | 7/2015 | Tanaka | |

OTHER PUBLICATIONS

Kenichi Tanaka et al., U.S. Appl. No. 14/722,279, filed May 27, 2015, Group 2852.

Kenichi Tanaka et al., U.S. Appl. No. 14/722,503, filed May 27, 2015, Group 2852.

* cited by examiner

CONTROL DEVICE, IMAGE FORMING APPARATUS AND FIXING DEVICE

FIELD OF THE INVENTION AND RELATED ART

The present invention relates to a control device, an image forming apparatus and a fixing device. This fixing device is usable in, e.g., a copying machine, a printer, a facsimile machine and a multi-function machine having a plurality of functions of these machines.

In a conventional image forming apparatus of an electrophotographic type, the fixing device for fixing a toner image formed on a recording material by using an electrophotographic process is mounted. This fixing device has a constitution in which the toner image is heated while nipping and feeding the recording material at a nip formed by a pair of rotatable members, e.g., a fixing roller and a pressing roller.

A state of a surface of the fixing roller has an influence on glossiness of an image, and therefore it has become important more than ever that a surface property of the fixing roller is stably maintained. However, when a side edge of the recording material continuously contacts the fixing roller at the same position, there is a tendency that a surface property at a portion thereof (contact portion) is inferior to that at another portion.

It would be considered that this is because the side edge of the recording material has a minutely bent (flexed) shape during manufacturing thereof, i.e., during cutting.

In such a background, when recording materials having the same width are continuously introduced into the fixing device, fixing roller potions contacting both side edges of the recording materials are damaged (also referred to as fixing device).

In such a state that the edge damage is generated on the fixing roller surface, when the image is formed on a recording material wider than the above recording materials, there is a liability that glossiness of the image at a portion corresponding to the edge damage is lowered compared with that at another portion and thus uneven glossiness is generated on the image.

Therefore, in an apparatus (device) described in Japanese Laid-Open Patent Application (JP-A) 2008-040365, the generation of uneven glossiness on the image is suppressed by rubbing the fixing roller surface with a roughening roller to level out the surface property of the fixing roller with respect to a longitudinal direction of the fixing roller, and therefore this method is an excellent method satisfactory to a general user.

However, in the method described in JP-A 2008-040365, it is difficult to completely eliminate the uneven glossiness of the image, and in the case where a required level by the user with respect to uniformity of the glossiness of the image is very high, it is difficult to deal with the uneven glossiness by using such a method.

SUMMARY OF THE INVENTION

According to an aspect of the present invention, there is provided a control device configured to control an image forming apparatus capable of forming an image by replacing a fixing device mounted therein with another fixing device including a storing portion configured to store information corresponding to a width of a recording material, the control device comprising: a reading portion configured to read the information corresponding to the width of the recording material stored in the storing portion; an obtaining portion configured to obtain information corresponding to a width of a recording material to be subjected to image formation; and a controller configured to control an operation of the image forming apparatus on the basis of the information read by the reading portion and the information obtained by the obtaining portion, wherein the controller prohibits an image forming operation when the width of the recording material obtained by the obtaining portion is smaller than the width of the recording material read by the reading portion.

According to another aspect of the present invention, there is provided a control device configured to control an image forming apparatus capable of forming an image by replacing a fixing device mounted therein with another fixing device including an indicating portion configured to indicate information corresponding to a width of a recording material, the control device comprising: a first obtaining portion configured to obtain the information corresponding to the width of the recording material indicated by in the indicating portion; a second obtaining portion configured to obtain information corresponding to a width of a recording material to be subjected to image formation; and a controller configured to control an operation of the image forming apparatus on the basis of the information obtained by the first obtaining portion and the information obtained by the second obtaining portion, wherein the controller prohibits an image forming operation when the width of the recording material obtained by the second obtaining portion is smaller than the width of the recording material obtained by the first obtaining portion.

According to another aspect of the present invention, there is provided an image forming apparatus comprising: an image forming device configured to form a toner image on a recording material; a fixing device configured to fix the toner image, formed by the image forming device, on the recording material; a storing portion configured to store information corresponding to a width of the recording material so as to limit a use of the fixing device; a reading portion configured to read the information corresponding to the width of the recording material stored in the storing portion; an obtaining portion configured to obtain information corresponding to a width of a recording material to be subjected to image formation; and a controller configured to control an operation of the image forming device on the basis of the information read by the reading portion and the information obtained by the obtaining portion, wherein the controller prohibits an image forming operation when the width of the recording material obtained by the obtaining portion is smaller than the width of the recording material read by the reading portion.

According to another aspect of the present invention, there is provided an image forming apparatus comprising: an image forming device configured to form a toner image on a recording material; a fixing device configured to fix the toner image, formed by the image forming device, on the recording material; an indicating portion configured to indicate information corresponding to a width of the recording material so as to limit a use of the fixing device; a first obtaining portion configured to obtain the information corresponding to the width of the recording material indicated by in the indicating portion; a second obtaining portion configured to obtain information corresponding to a width of a recording material to be subjected to image formation; and a controller configured to control an operation of the image forming device on the basis of the information obtained by the first obtaining portion and the information obtained by the second obtaining portion, wherein the controller prohibits an image forming operation when the width of the recording material obtained by the second obtaining portion is smaller than the width of the recording material obtained by the first obtaining portion.

According to another aspect of the present invention, there is provided a fixing device detachably mountable to an image forming apparatus, comprising: a pair of rotatable member forming a nip configured to fix a toner image on a recording material by heat and pressure; and a storing portion configured to store information corresponding to a width of the recording material so as to limit a use of the fixing device in the image forming apparatus.

According to another aspect of the present invention, there is provided a fixing device detachably mountable to an image forming apparatus, comprising: a pair of rotatable member forming a nip configured to fix a toner image on a recording material by heat and pressure; and an indicating portion configured to indicate information corresponding to a width of the recording material so as to limit a use of the fixing device.

According to a further aspect of the present invention, there is provided a control device, including a display portion, configured to control an image forming apparatus capable of forming an image by replacing a fixing device mounted therein with another fixing device including a storing portion configured to store information corresponding to a width of a recording material, the control device comprising: a reading portion configured to read the information corresponding to the width of the recording material stored in the storing portion; a controller configured to control the display portion so that display for permitting selection of the width of the recording material to be subjected to image formation, from a plurality of options, wherein the controller disables the selection of the recording material having a width smaller than the width of the recording material read by the reading portion.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described, but although the following embodiments are examples of preferred embodiments, the present invention is not limited to the following embodiments.

[Embodiment 1]

(General Structure of Image Forming Apparatus)

Figure 2:
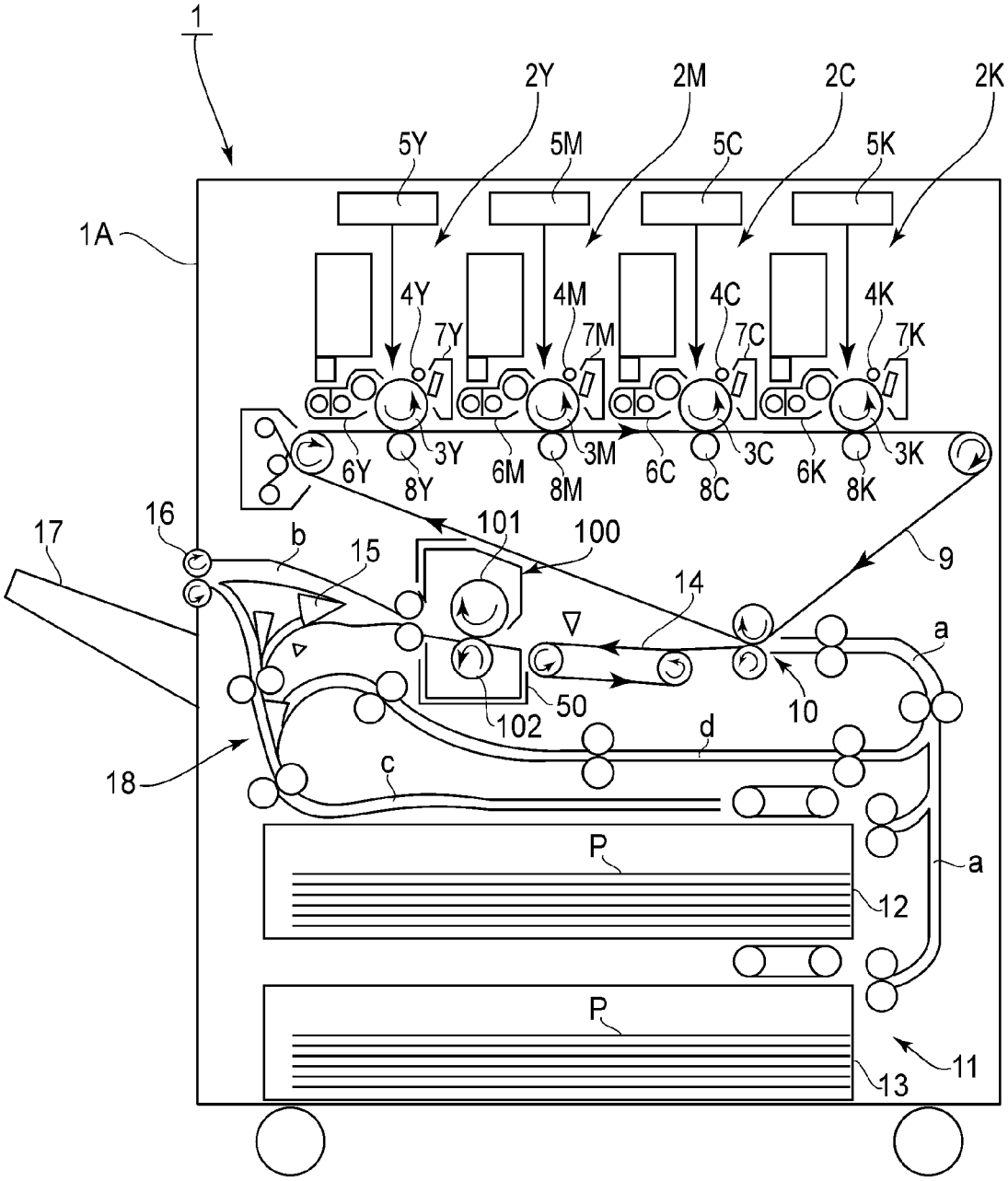
FIG. 2 is a schematic view showing a structure of the image forming apparatus in Embodiment 1.

FIG. 2 is a schematic view showing a general structure of an image forming apparatus 1 in this embodiment. This image forming apparatus 1 is an electrophotographic full-color printer which is of an intermediary transfer type and which has a both-side image forming function. Inside an apparatus main assembly (image forming apparatus main assembly) 1A of the image forming apparatus 1, e.g., four image forming portions 2Y, 2M, 2C and 2K corresponding to Y (yellow), M (magenta), C (cyan) and K (black) are disposed in series as an image forming device. That is, as the image forming device, a tandem type in which a process until a visible image is formed is performed in parallel among the respective colors of Y, M, C and K is employed.

In order to prevent cumbersome description, the four image forming portions for the respective colors of Y, M, C and K will be described by representing these portions as a symbol "2", and this is similarly applied to the following associated process means. Further, the order of arrangement of the image forming portions 2 for the respective colors of Y, M, C and K is not limited to the above order.

At each of the image forming portions 2, the following respective electrophotographic process means are provided. That is, a photosensitive member (image bearing member) 3 for bearing an electrostatic latent image on a surface thereof correspondingly to an associated one of the colors of Y, M, C and K, a primary charger 4, an exposure device 5, a developing device 6 and a cleaning device 7 are provided.

The primary charger 4 electrically charges the surface of an associated photosensitive member 3 uniformly by applying a charging bias voltage having a set potential. The surface of the photosensitive member 3 is exposed to light by the exposure device 5 correspondingly to an image information pattern, so that the electrostatic latent image is formed. The electrostatic latent image is developed with a toner (developer) by the developing device 6, thus being changed into a visible image as a toner image.

Toner images of the respective colors of Y, M, C and K which are formed and carried on the surfaces of the photosensitive members 3 of the respective image forming portions 2 are successively primary-transferred superposedly onto an endless belt as an intermediary transfer member 9 by a primary transfer device 8. A primary transfer residual toner on each of the photosensitive members 3 is removed by the cleaning device 7.

An unfixed full-color toner image formed on the intermediary transfer member 9 by superposing the toner images of all the colors of Y, M, C and K is collectively secondary-transferred by a secondary transfer device 10 onto a recording material P as a recording medium fed from a feeding portion 11 to the secondary transfer device 10.

The recording material (hereinafter referred to as a sheet) P is an image formable sheet-like member and may include plain paper, glossy paper, a resin-made sheet such as an OHP sheet, thick paper, an envelope, a postcard, a label or the like. In the image forming apparatus 1 in this embodiment, the feeding portion 11 includes sheet cassettes 12 and 13 as upper and lower cassette portions each accommodating sheets P. Further, a feeding member for the sheet cassette accommodating sheets P having a width selected and designated in advance is driven, so that one of the sheets P in the cassette is separated and fed to the secondary transfer device 10 through a feeding path a.

The width of the sheet P is a sheet dimension with respect to a direction perpendicular to a sheet feeding direction X (FIG. 1) on a sheet surface. In the image forming apparatus 1 in this embodiment in this embodiment, independently of the width of the sheet P, the sheet P is introduced into a fixing device 100 so that a center position of the sheet P with respect to a width direction of the sheet P substantially coincides with a center position of the fixing device 100 with respect to the width direction of the fixing device 100.

The sheet P passed through the secondary transfer device 10 is separated from the intermediary transfer member 9 and is guided by a feeding device 14 into the fixing device 100 as an image heating apparatus. The fixing device 100 applies heat and pressure to the unfixed toner image while nipping and feeding the sheet P, thus fixing the toner image as a fixed image as described later.

In the case of a one-side image forming mode, the sheet P coming out of the fixing device 100 is changed in course to a feeding path b side by a flag 15, and is discharged, as a full-color image-formed product (resultant product) on which the image is formed on one surface, onto a discharging tray 17 by a discharging roller pair 16.

In the case of a double-side image forming mode, the sheet P which comes out of the fixing device 100 and on which the image has already been formed on a first surface is changed in course to a double-side feeding path mechanism 18 side by the flag 15. Then, the sheet P is fed in a switch-back manner after being fed into a feeding path c of the mechanism 18, and is fed again into the feeding path a via a feeding path d in an upside-down state, thus being fed to the secondary transfer device 10. As a result, the secondary transfer of the toner image from the intermediary transfer member 9 onto a second surface of the sheet P is made.

Therefore, similarly as in the case of the one-side image forming mode, the sheet P is fed through a course in the order of the feeding device 14, the fixing device 100, the feeding path b and the discharging roller pair 16, and is discharged, as a full-color image-formed product (resultant product) on which the image is formed on both (first and second) surfaces, onto the discharging tray 17.

(Fixing Device)

Figure 1:
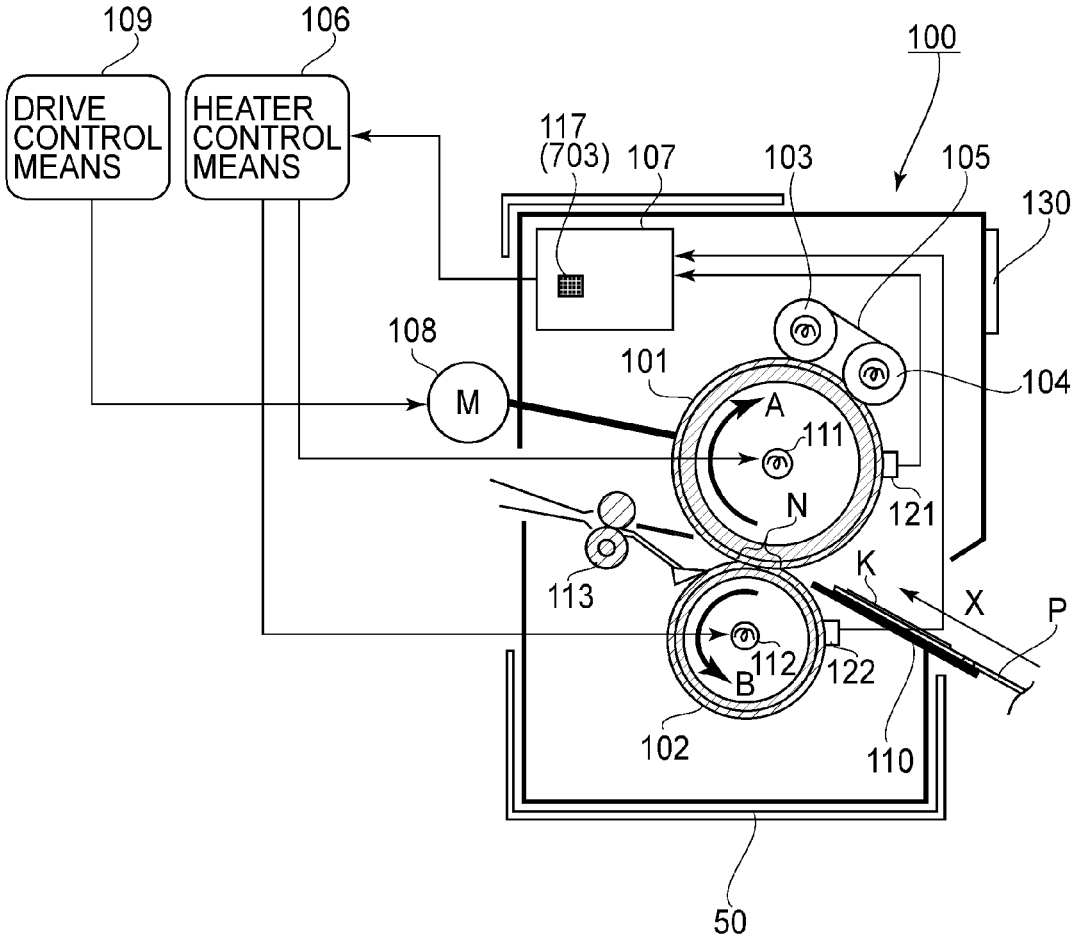
FIG. 1 is a schematic enlarged view of a fixing device portion in an image forming apparatus of FIG. 2.

FIG. 1 is an enlarged schematic view of the fixing device 100. The fixing device 100 is detachably mounted as a fixing unit in a mounting portion 50 of the apparatus main assembly 1A of the image forming apparatus 1 in a predetermined manner (procedure). The fixing device 100 is mounted so as to be positioned and fixed to the mounting portion 50 of the apparatus main assembly 1A of the image forming apparatus 1, and in this state, is electrically and mechanically connected with a controller, an electric power supplying portion, a driving mechanism portion and the like in the apparatus main assembly 1A side in a predetermined manner, thus receiving supplied electric power and a driving force from the apparatus main assembly 1A side.

The fixing device 100 includes a pair of rotatable members for forming a nip (fixing nip) N where the sheet P carrying thereon an unfixed toner image K is nipped and fed, i.e., a fixing roller (fixing member) 101 and a pressing roller (opposite member, pressing member) 102. Further, the fixing device 100 includes an external heating belt 105, for externally heating the fixing roller 101, rotatably stretched by supporting rollers 103 and 104. Further, the fixing device 100 includes a web cleaning device (not shown) for cleaning the surface of the fixing roller 101.

The fixing roller 101 is prepared by forming a parting layer of a heat-resistant resin material on an outer peripheral surface of a core metal and is rotationally driven in the clockwise direction of an arrow A at a predetermined peripheral speed by a driving motor (driving mechanism) 108 controlled with respect to a rotational speed by a drive control means (motor controller) 109. Inside the core metal of the fixing roller 101, a halogen heater 111 as an internal heat generating element is provided, and heats the fixing roller 10 in combination with the external heating belt 105 so that a surface temperature of the fixing roller 101 is a predetermined temperature.

The pressing roller 102 is prepared by forming a heat-resistant elastic layer on an outer peripheral surface of a core metal, and is disposed in parallel to the fixing roller 101. Further, by an unshown pressing means, the pressing roller 102 is pressed toward the fixing roller 101 at a predetermined pressure against elasticity of the elastic layer, so that the fixing nip N having a predetermined width with respect to the feeding direction X of the sheet P is formed between itself and the fixing roller 101.

The pressing roller 102 is rotated by the rotational drive of the fixing roller 101 in the counterclockwise direction of an arrow B at a peripheral speed corresponding to the peripheral speed of the fixing roller 101. Inside the core metal of the pressing roller 102, a halogen heater 112 as the heat generating element is provided, so that the pressing roller 102 is heated from an inside thereof so that a surface temperature of the pressing roller 102 is a predetermined temperature.

The surface temperature of the fixing roller 101 is detected by a thermistor 121 as a temperature detecting means contacting the fixing roller 101. The surface temperature of the pressing roller 102 is detected by a thermistor 122 contacting the pressing roller 102. Electrical signals relating to the temperatures outputted from the thermistors 121 and 122 are once collected by a fixing device substrate (electrostatic circuit substrate) 107 provided in the fixing device 100, and thereafter are inputted into a heater control means 106 as a temperature control (adjusting) means.

The heater control means 106 turns on and off the respective halogen heaters 111 and 112 on the basis of detected temperatures of the thermistors 121 and 122, respectively, so that the heater control means 106 controls the heaters so that each of the surface temperature of the fixing roller 101 and the surface temperature of the pressing roller 102 is the predetermined temperature.

The fixing device substrate 107 also has the following functions in addition to the temperature detection of the thermistors 121 and 122. That is, the fixing device substrate 107 also has the function of controlling drive of a motor for operating a contact-and-separation mechanism for moving the pressing roller 102 toward and away from the fixing roller 101 and the function of collecting signal lines and power lines which are used for operating a sensor for detecting positions (pressing state position and pressing-eliminated state position) of the contact-and-separation mechanism.

The rotational drive of the fixing roller 101 and the following rotation of the pressing roller 102 with the rotation drive of the fixing roller 101 are made, and the surface temperatures of both of the rollers are increased up to the predetermined temperatures, so that temperature control is made. In this fixing device state, the sheet P which passed through the secondary transfer device 10 and which is fed into the fixing device 100 by the feeding device 14 is guided by a guiding member 110 into the nip N, and is nipped and fed. A carrying surface of the sheet P which is to be guided into the nip N and which carries the unfixed toner image K is directed upward, and faces the fixing roller 101.

In this way, by nipping and feeding the sheet P through the nip N, the unfixed toner image K is fixed as the fixed image on the surface of the sheet (recording material) P under application of heat and pressure. The sheet P coming-out of the nip N is separated from the fixing roller 101 and the pressing roller 102, and is sent from the inside of the fixing device 100 by a discharging roller pair 113 for the fixing device 100. The web cleaning device wipes and removes an offset toner on the surface of the fixing roller 101. The external heating mechanism (103, 104, 105) is provided upstream of the nip N and downstream of the web cleaning device with respect to the fixing roller rotational direction.

In this embodiment, on the substrate 107 of the fixing device 100, a holding portion 117 for holding information (information relating to an operating condition) for limiting a use of the fixing device 100 is mounted. In this embodiment, this holding portion 117 is a nonvolatile memory (storing portion) represented by ROM, RAM, flash memory or the like.

Specifically, the above information is information corresponding to a specific width of the recording material capable of being introduced into the fixing device, and the information is stored (held) in a storing region 703 of the memory 117. That is, in the storing region 703, for a user who requires a high level of uniformity in glossiness of the image, specific width information of the recording material depending on the user's demand (requirement) is stored. This specific width is a dimension of the recording material with respect to a direction perpendicular to the feeding direction X and is hereinafter referred to as an exclusive width. That is, for such a user, in principle, it becomes possible to provide a fixing device exclusively for the recording material having the specific width.

Accordingly, the fixing device mounted in the image forming apparatus 1 can be replaced with the fixing device for the width of the specific recording material to be subjected to the image formation. That is, the user possesses a plurality of fixing devices at the same time.

Further, on these fixing devices 100, at a position which is readily recognized by the user (operator), a discriminating member 130 having a visible label (writing) indicating a specific width (W) corresponding to information stored in the memory 117 may also be provided.

Further, writing of the above information into the memory 117 may also be performed through a display portion (touch panel) 701A described later. In this case, the writing of the above information into the memory 117 may only be required to be performed after the fixing device mounted in the image forming apparatus is replaced with an unused fixing device 100 and before the image formation is effected.

In the case where the user or the operator intends to completely avoid generation of uneven glossiness of the image due to edge damage which can occur on the surface of the fixing roller 101, from the plurality of these fixing devices 100, the fixing device 100 for the sheet (exclusive width setting) having the specific width in order to limit the use of the fixing device is selected.

The selection can be made after seeing the label (writing) of the discriminating member 130. Then, the selected fixing device 100 can be used after the mounted fixing device 100 is exchanged (replaced) with the selected fixing device 100 and is mounted in the mounting portion 50 of the apparatus main assembly 1A. As a result, it becomes possible to reliably prevent generation of an image defect due to the edge damage.

(Control Device)

Figure 3:
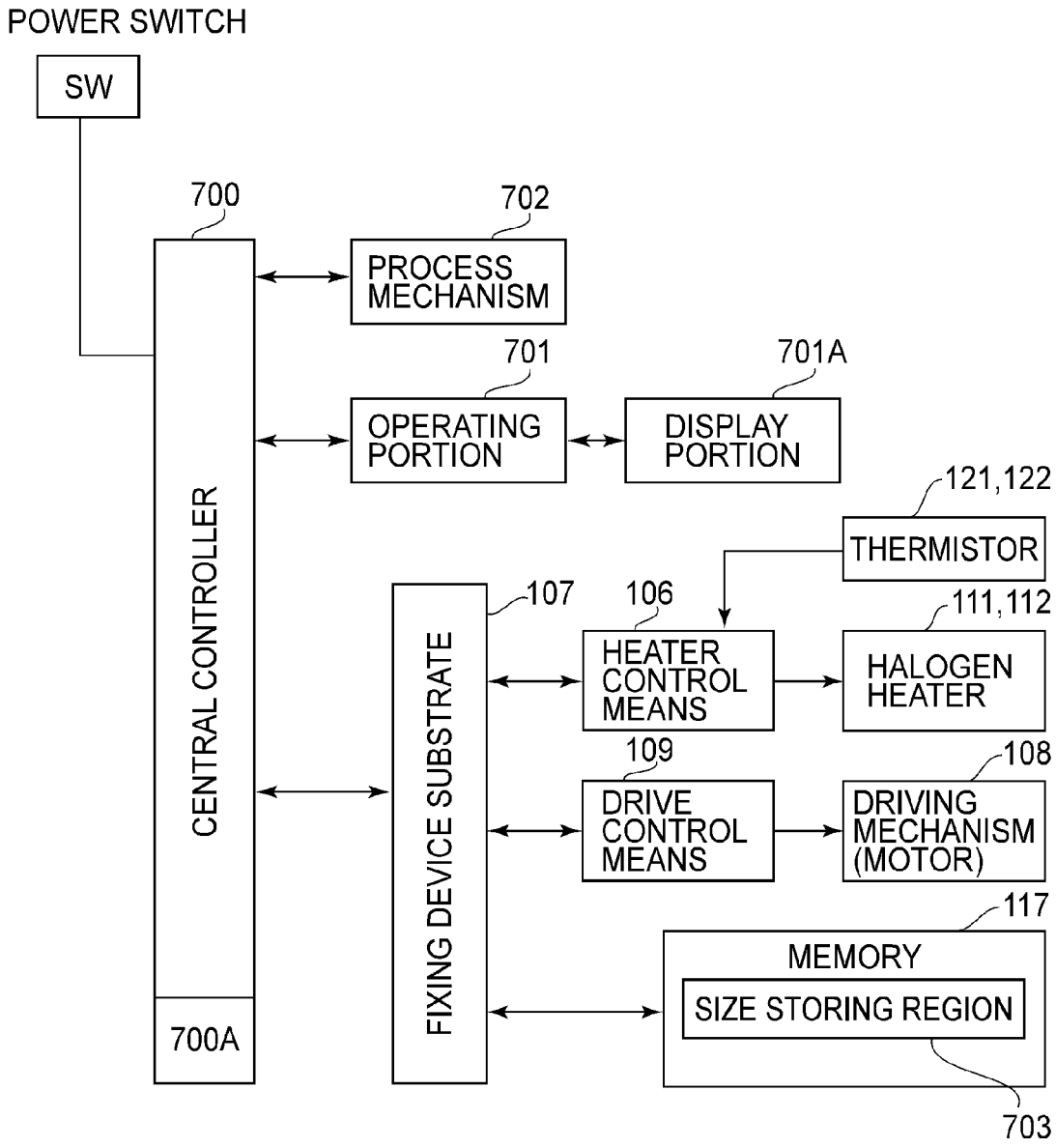
FIG. 3 is a block diagram of an outline of a control system.

FIG. 3 is a block diagram of an outline of a control system of the image forming apparatus 1. A general printing operation (image forming operation) of an image forming process mechanism 702 of the image forming apparatus 1 is controlled by a central controller 700 controlled by CPU.

Figure 5:
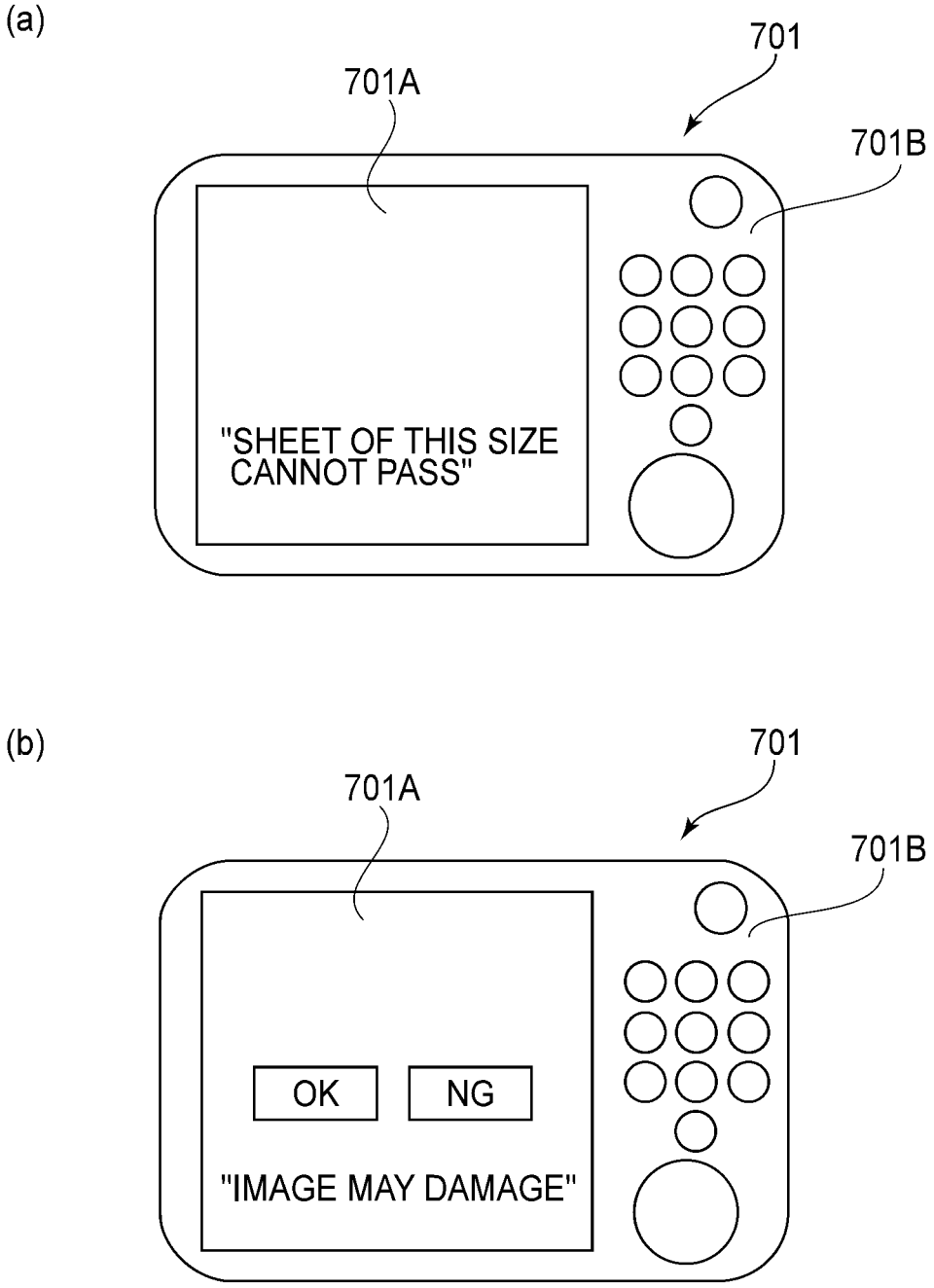
In FIG. 5, (a) and (b) are illustrations each showing an information display of an operating portion.

An operating portion 701 functions as an inputting means, of various pieces of information, such as a recording material size inputting means. The operating portion 701 includes a display portion (information display portion) 701A and an operating button portion 701B as shown in FIG. 5. At the operating button portion 701B, various settings of the printing operation performed by the image forming apparatus 1 are inputted. The display portion 701A is a liquid crystal screen of a touch panel type, and at the display portion 701A, not only information display of various messages or the like but also display of various operation buttons (keys) are made. Also by the displayed operation buttons, it is possible to instruct the various settings of the printing operation performed by the image forming apparatus 1.

The fixing device substrate 107 is in an electrically connected state with the controller 700 of the apparatus main assembly 1A side in a state in which the fixing device 100 is mounted in the mounting portion 50 of the apparatus main assembly 1 in a predetermined manner. Further, an information reading function portion (reading portion, obtaining portion) 700A of the controller 700 can read stored information from the memory (storing portion) 117 of the fixing device substrate 107. In this embodiment, the information is stored (held) in the size storing region 703 of the memory 117 in advance. That is, as information relating to an operating condition of the fixing device, it is possible to read information corresponding to the specific width of the sheet to be subjected to the image formation.

Figure 4:
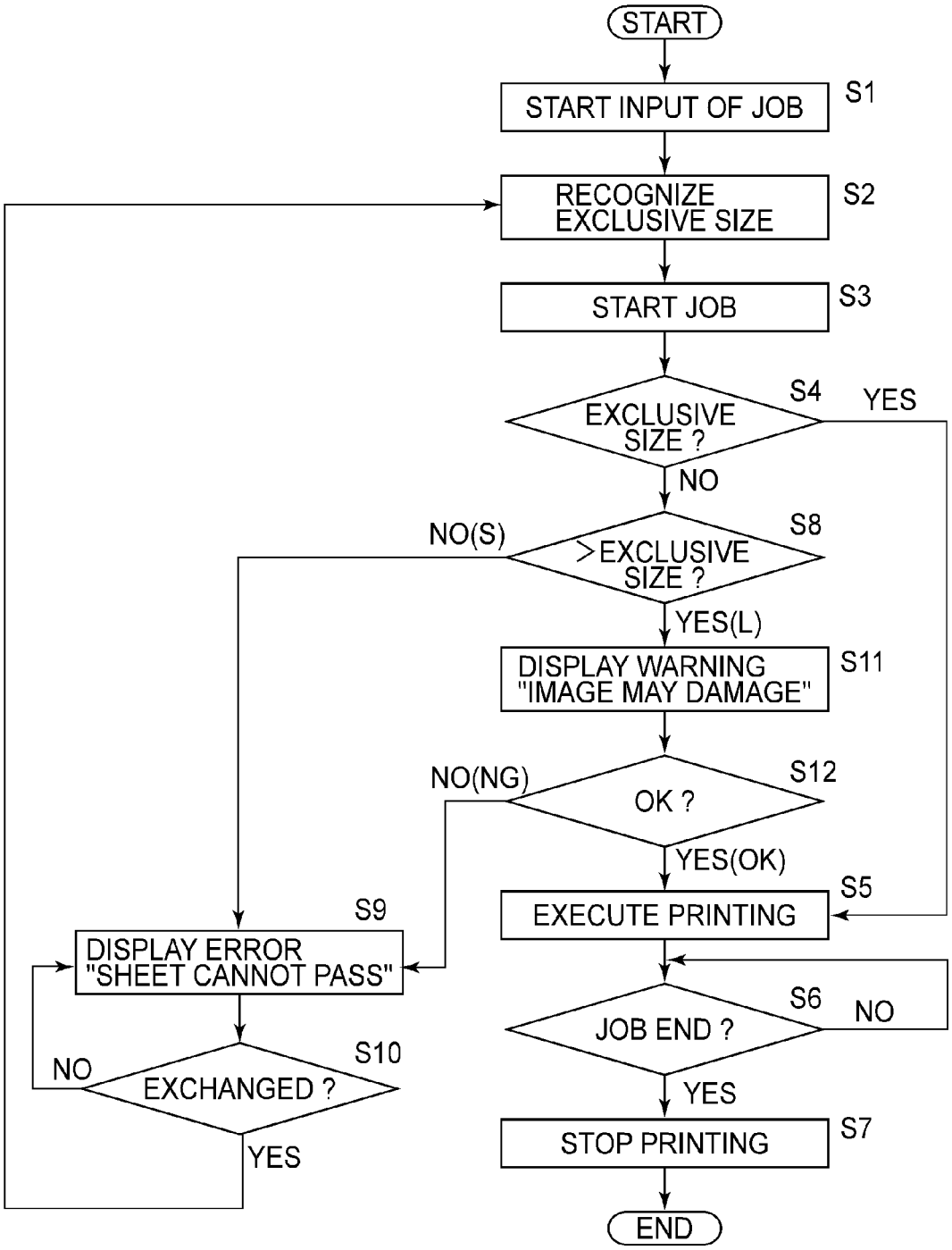
FIG. 4 is a control flowchart.

FIG. 4 is a flowchart of control effected by the controller 700 in the case where a print job is inputted. When the user starts an inputting operation of print job contents through the operating portion 701 (S1), the information reading function portion 700A of the controller 700 detects (recognizes) the exclusive width W of the sheet stored in the size storing region 703 of the fixing device substrate 107 of the fixing device 100 currently mounted in the mounting portion 50 of the apparatus main assembly 1A (S2). This detection of the exclusive width W can also be performed when a (main) power switch SW (FIG. 3) of the image forming apparatus 1 is turned on.

The controller 700 can also have a program constitution in which exclusive width information of the fixing device 100 detected by the information reading function portion 700A is displayed at the display portion 701A of the operating portion 701.

By the user, the input of the print job contents advances, so that a basis weight, a size, the number of sheets and the like of the sheet P used are designated (printing setting), and thus the job is started (S3). At this time, the controller (also having the function of the obtaining portion) 700 makes reference to the exclusive width W detected in the step S2, and obtains a width W2 of the sheet P designated by the printing setting (print job contents) in the step S3. Then, the controller 700 checks whether or not the width W2 coincides with the exclusive width W (S4). Then, in the case where the width W2 and the exclusive width W coincide with each other, the controller 700 performs a printing operation in accordance with the inputted print job contents (S5), and when the job is completed, the controller 700 steps the printing operation (S6, S7).

On the other hand, in the case where the width W2 does not coincide with the exclusive width W in the step S4, the controller 700 discriminates whether the width W2 is larger or smaller than the exclusive width W (S8). In the case where the width W2 is smaller than the exclusive width W, an error message saying "SHEET OF THIS SIZE CANNOT PASS" as shown in (a) of FIG. 5 is displayed at the display portion 701A of the operating portion 701 (S9). That is, the image forming operation is prohibited, and replacement and mounting of the fixing device is prompted at the display portion 701A.

After the display of the error, the controller 700 maintains the image forming apparatus 1 in a stand-by state. The user performs a replacing operation, on the basis of the above-described error message, in which the fixing device 100 currently mounted in the apparatus main assembly 1A is exchanged with the fixing device 100 for which the exclusive width W corresponding to the width W2 of the sheet inputted in the step S1 and then is mounted in the apparatus main assembly al (S10). When the fixing device 100 is exchanged, the sequence goes back to the step S2, and the exclusive width W stored in the size storing region 703 of the fixing device 100 is detected, and then the controller 700 executes again the above-described control steps.

On the other hand, in the step S8, in the case where the width W2 of the sheet is larger than the exclusive width W, the controller 700 displays a warning that "IMAGE MAY DAMAGE" as shown in (b) of FIG. 5 at the display portion 701A of the operating portion 701 (S11). Further, together with the display of this warning, selection buttons (keys) of "OK" (key for permitting the image forming operation) and "NG" (key for not permitting the image forming operation) are displayed on the touch panel of the display portion 701A of the operating portion 701 to seek a user's determination (selection) (S12).

In the case where the user selects "OK" (input of information of permission), the controller 700 executes the printing operation in accordance with the print job contents inputted in the step S1 (S5), and when the job is completed, the printing operation is stopped (S6, S7). On the other hand, the user selects "NG" (input of information of non-permission), the sequence goes to the step S9, and the error message saying "SHEET OF THIS SIZE CANNOT PASS" as shown in (a) of FIG. 5 is displayed at the display portion 701A of the operating portion 701. Accordingly, the image forming operation is not performed.

Then, the controller displays, at the display portion, a message prompting exchange to the fixing device 100 in which the width W which coincides with the width W2 of the sheet obtained in the step S1 is stored in the memory 117. During the period (period until the replacement of the fixing device is performed), the image forming apparatus 1 is maintained in a stand-by state (S10).

The specific width of the sheet stored in the size storing region 703, i.e., the exclusive width W may also have a certain range, not a certain one value. For example, in the case where a width of the sheet P intended to be exclusively used is W1, a width of the sheet designated by printing setting is W2, and a region width in which the image formation of the sheet P is not effected is W3 (a width of a non-image forming region at each of both side portions of an image forming region with respect to the width direction of the sheet), if W1 W2 W1+2×W3 is satisfied, even when the sheet P having the width W2 designated by the printing setting is passed, there is no problem of edge damage due to the width W1 of the sheet P intended to be exclusively passed since the region corresponds to the non-image forming region of the sheet P provided by the print job. Accordingly, in discrimination in the step S4 in FIG. 4, satisfaction of W1<W2<W1+2×W3 by the width W2 provided by the print job may also be used as a criterion of the discrimination that the widths coincide with each other in the step S4.

An effect by carrying out this embodiment will be described with reference to FIG. 6. In the case where sheets having the same width as the exclusive width W set for the fixing device 100 are passed in a large amount, as shown in (a) of FIG. 6, edge damage 101*a* continuously extending in a circumferential direction of the fixing roller 101 generates at positions corresponding to the exclusive width W on the surface of the fixing roller 101. This phenomenon similarly generates on the surface of the pressing roller 102, and therefore will be omitted. Y is a center (line)-basis feeding line (phantom line) of the sheet P.

Figure 6:
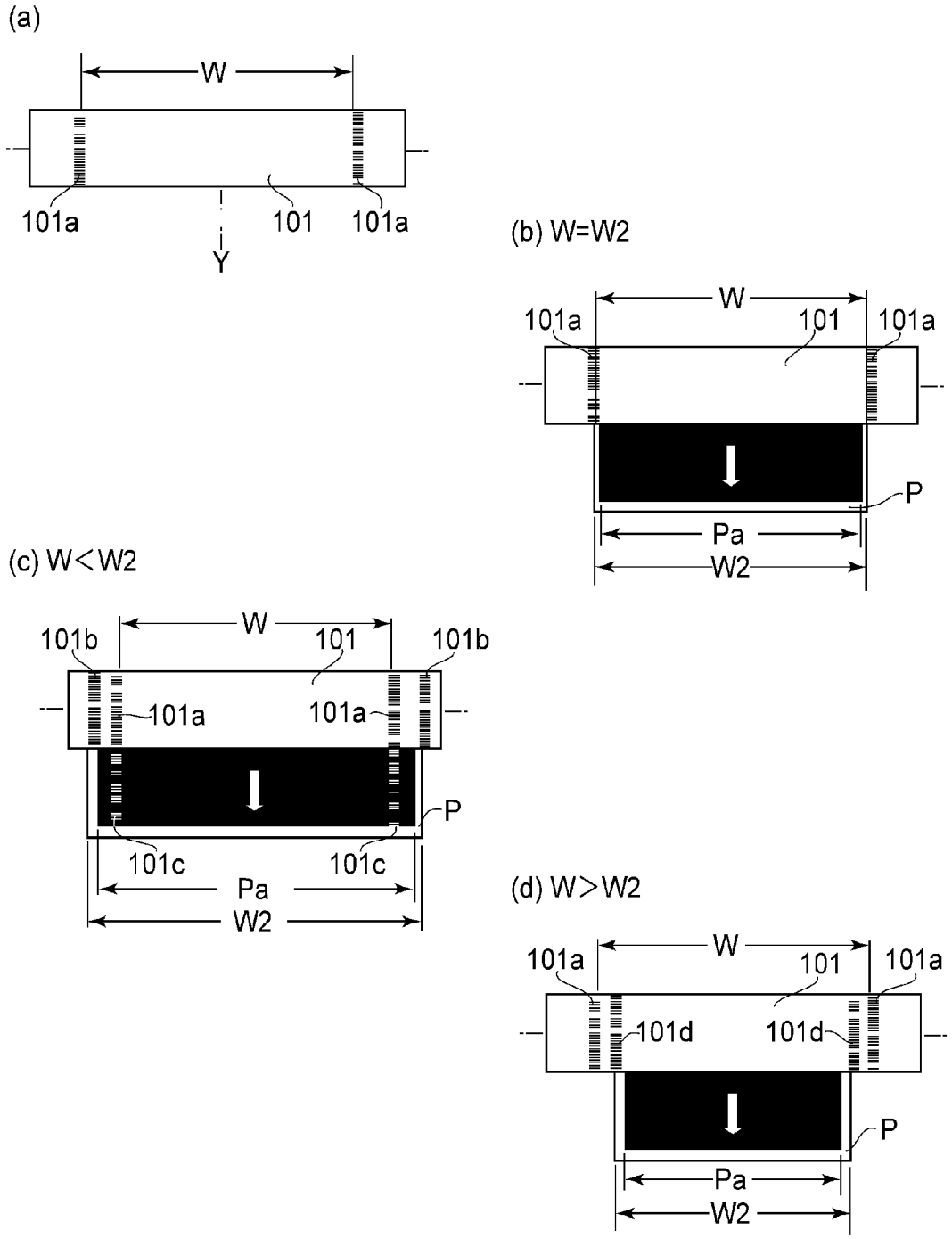
In FIG. 6, (a) to (d) are relational views each showing a relationship between edge damage of a fixing roller and a recording material.

In a state in which such edge damage 101*a* generates on the surface of the fixing roller 101, as shown in (b) of FIG. 6, the case where the sheet P having the width W2 equal to the exclusive width W (W=W2) set for the fixing device 100 will be considered. In this case, the edge damage 101*a* of the fixing roller 101 positions outside an image forming region width Pa of the sheet P. Accordingly, in an image forming region of the sheet P, an image defect due to transfer of the edge damage 101*a* of the fixing roller 101 does not generate. An open (hollow) arrow represents the feeding direction of the sheet P.

Incidentally, on the fixing roller 101 or the pressing roller 102, the edge damage 101*a* (102*a*) generates only at the positions of the width W, and therefore there is no influence on the sheet P, having the width W2 corresponding to the exclusive width W, to be passed thereafter.

In FIG. 6, (c) shows the case where the width W2 of the sheet P designated by the printing setting is larger than the exclusive width W set for the fixing device 100 (W<W2). In this case, in the image forming region of the sheet P, there is a possibility that an image defect 101*b* due to the edge damage 101*a* generates. In such a case, as in the step S11 in FIG. 4, in the case where the possibility of the generation of the damage 101*b* on the image can be permitted by obtaining confirmation by the user, passing of the sheet P having the width W2 larger than the exclusive width W is permitted.

At this time, on the fixing roller 101 on the pressing roller 102, as shown in (c) of FIG. 6, edge damage 101*c* can generate within the width W2. However, as shown in (b) of FIG. 6, when the sheet P having an exclusive width which is the width W2 corresponding to the exclusive width W (W=W2) set for the fixing device 100 is passed, the image defect due to transfer of the edge damage 101*a* or 101*b* does not generate in the image forming region Pa. For that reason, there is no influence on a desired sheet P to be passed thereafter.

Next, as shown in (d) of FIG. 6, the case where the width W2 of the sheet P for use provided in the print job is smaller than the exclusive width W (W>W2) set for the fixing device 100 will be considered. In this case, in the image forming region of the sheet P, the image defect due to the edge damage 101*a* does not generate.

However, in the case where this sheet is passed, edge damage 101*d* generates at positions of the width W2 on the fixing roller 101 or the pressing roller 102. That is, when the sheet P having the exclusive width W is passed thereafter, there is a possibility that the image defect due to the edge damage 101*d* generates in the image forming region of the sheet P.

Therefore, in this embodiment, in the case where the width W2 of the sheet P designated by the printing setting is smaller than the exclusive width W (W>W2) set for the fixing device 100, the error is displayed as in the step S9 of FIG. 4, so that execution of the print job is prohibited.

As described above, a plurality of fixing devices 100 having setting of the exclusive width for each of sizes (widths) of the sheets P used in the image forming apparatus 1 are prepared. Then, the control device controls whether or not the image forming operation should be permitted depending exclusive width information of the sheet for limiting the use of the fixing device 100 mounted in the image forming apparatus 1 and width image form of the sheet designated by the printing setting.

As a result, it is possible to prevent passing of the sheet, having the width other than the width corresponding to the exclusive width of the sheet associated with the fixing device 100, caused by an error in fixing device 100 to be replaced and mounted in the apparatus main assembly 1A or by an erroneous operation of the user. For that reason, it is possible to prevent the generation of the image defect due to the edge damage within the image forming region Pa of the sheet P.

Further, in the case where the width W2 of the sheet P designated in the printing setting (print job) by the user is larger than the exclusive width W (W<W2) of the sheet associated with the fixing device 100, the warning that there is a possibility of generation of damage on the image is made and then determination of the user is sought. For example, in the case where such a resultant product that image damage is not conspicuous or the user does not worry about the image damage is intended to be outputted, it becomes possible to effect the sheet passing without exchanging the fixing device 100. Accordingly, it becomes possible to execute such printing with no waiting time.

Incidentally, e.g., in the case where plain paper low in glossiness is used as the sheet P and a text document is printed, even when the edge damage generates on the fixing roller 101, the image defect due to the edge damage is hardly recognizable on the fixed image. For this reason, in the case where the size information is not stored in the size storing region 703, it is also possible to pass the sheets P having all the widths through the fixing device 100.

[Embodiment 2]

Figure 7:
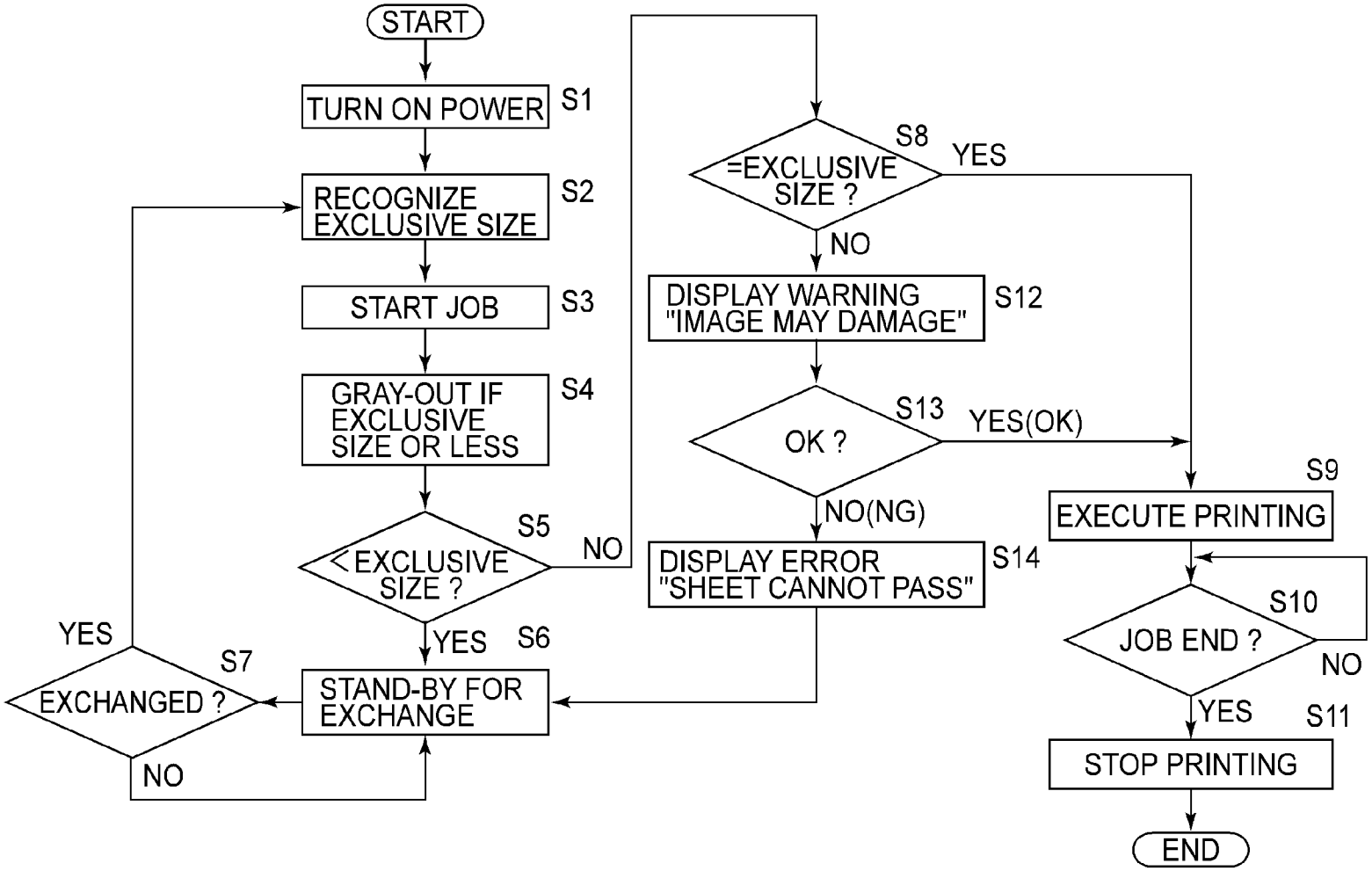
FIG. 7 is a control flowchart in Embodiment 2.

In Embodiment 2, with respect to the constitutions of the image forming apparatus 1 and the fixing device 100 and the block diagram of the control system in FIG. 3, they are common to Embodiments 1 and 2, and therefore will be omitted from redundant description. A control operation in the case where the print job is inputted into the controller 700 in this embodiment will be described using a control flowchart of FIG. 7.

When the (main) power switch SW (FIG. 3) of the image forming apparatus 1 is turned on (S1), the controller 700 detects (recognizes) the exclusive width W stored in advance in the size storing region 703 of the fixing device 100 currently mounted in the mounting portion 50 of the apparatus main assembly 1A (S2).

Figure 8:
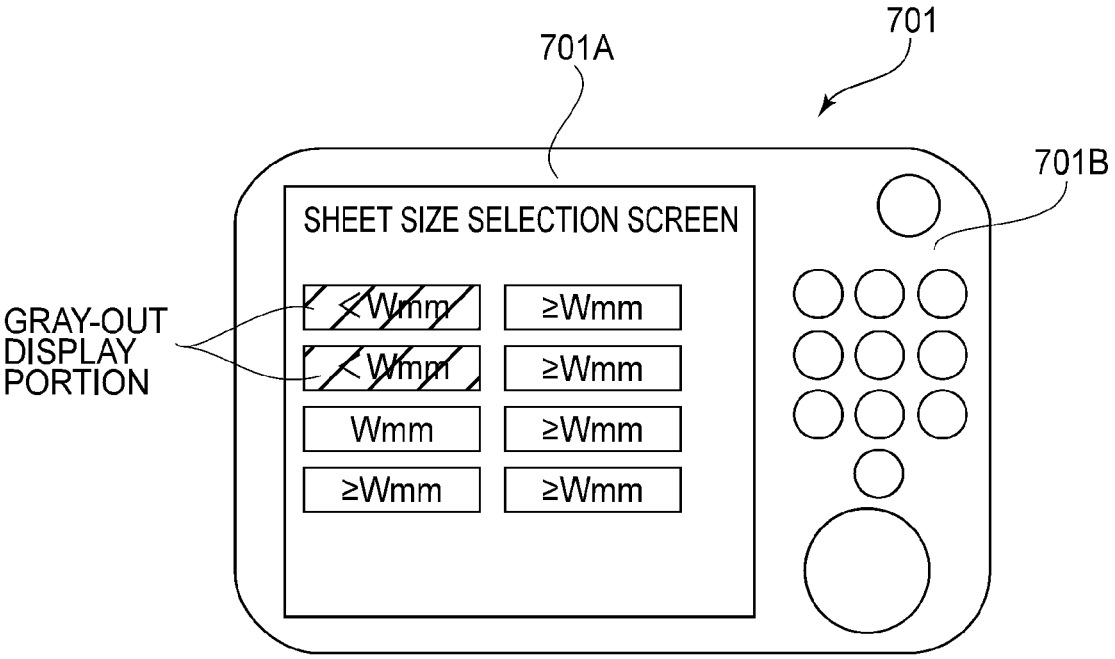
FIG. 8 is an illustration of information display of an operating portion in Embodiment 2.

By the user, printing setting (print job contents) for designating a basis weight, a size, the number of sheets and the like of the sheet P are inputted through the operating portion 701, and thus the job is started (S3). At this time, at the display portion 701A of the operating portion 701, as shown in FIG. 8, a sheet size selection screen for selecting the sheet size is displayed. Specifically, the controller controls the display portion so that display for causing the user to select, as the width of the sheet to be subjected to image formation, one of a plurality of options is made.

The sheet size is displayed so that only a set value not less than the exclusive width W detected in the step S2 is selectable. That is, on the sheet size selection screen at the display portion 701A of the operating portion 701, the display portion for the width less than the exclusive width W detected in the step S2 grays out (selection prohibition) and is made unselectable (S4).

In the case where the image is intended to be formed on the sheet having a width W4 smaller than the exclusive width W (S5), the controller 700 places the image forming apparatus 1 in a stand-by state until the exchange of the fixing device 100 is made (S6). That is, the image forming apparatus 1 continuous the stand-by state until the fixing device 100 currently mounted in the mounting portion 50 of the apparatus main assembly 1A is exchanged by the unit with the fixing device 100 having setting that the exclusive width W coincides with the width W4 or is smaller than the width W4. When the fixing device 100 is exchanged (S7), the sequence goes back to the step S2.

On the other hand, in the step S5, in the case where the width W4 of the sheet P intended to be used by the unit is not less than the exclusive width W detected in the step S2, the unit can select the width, of the sheet P intended to be used, on the width selection screen (FIG. 8) of the display portion 701A of the operating portion 701.

Then, in the case where the user selects the sheet P having the width which coincides with the exclusive width W detected in the step S2 (YES of S8), the controller 700 executes the printing operation in accordance with the print job contents inputted in the step S3 (S9). Then, when the job is completed, the printing operation is stopped (S10, S11).

In the case where the sheet P having the width larger than the exclusive width W detected in the step S2 (NO of S8), the controller 700 displays a warning that "IMAGE MAY DAMAGE" as described above with respect to (b) of FIG. 5 at the display portion 701A of the operating portion 701 (S12). Further, together with the display of this warning, selection buttons of "OK" and "NG" are displayed at the display portion 701A of the operating portion 701 to seek a user's determination (selection) (S13).

In the case where the user selects "OK", the controller 700 executes the printing operation in accordance with the print job contents inputted in the step S3 (S9), and when the job is completed, the printing operation is stopped (S10, S11).

On the other hand, the user selects "NG", the sequence goes to the step S13, and the error message saying "SHEET OF THIS SIZE CANNOT PASS" as described above with reference to (a) of FIG. 5 is displayed at the display portion 701A of the operating portion 701. Then, the image forming apparatus 1 is maintained in the stand-by state until the fixing device 100 currently mounted in the mounting portion 50 is exchanged with the fixing device 100 for which the exclusive width W corresponding to the width W2 of the sheet, to be used, inputted in the step S3 is set (S6, S7).

An effect obtained by the control in this embodiment in this embodiment is similar to the above-described effect obtained by the control in Embodiment 1, and therefore will be omitted from redundant description.

[Embodiment 3]

In Embodiment 1, the information (width information of the specific recording material) for limiting the use of the fixing device 100 is held (stored) in the memory 117, but in this embodiment, this point differs from Embodiments 1 and 2. Other constitution are similar to those in Embodiments 1 and 2, and therefore will be omitted from detailed description.

Figure 9:
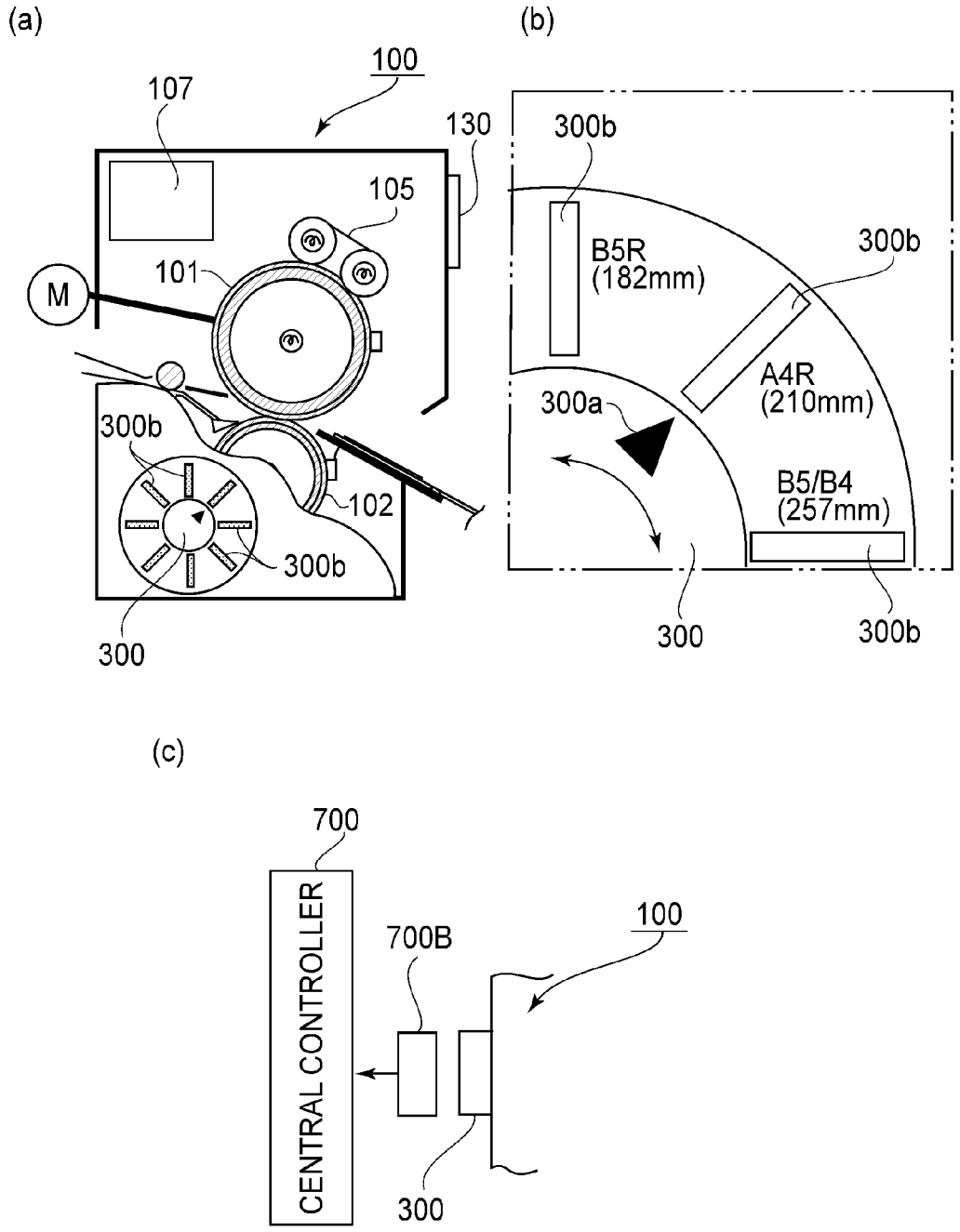
In FIG. 9, (a) to (c) are illustrations of portions other than a memory in Embodiment 3.

In FIG. 9, (a) to (c) show an example using a mechanical dial 300. Specifically, as shown in (a), on a front surface portion of the fixing device 100, a movable dial 300 for setting the exclusive width is mounted. In FIG. 9, (b) is a partly enlarged view of a portion of the dial 300. The dial 300 is constituted so that the user turns the dial 300 to adjust an indicator (selecting portion) 300*a* to a desired label portion of sheet width labels 300*b* and thus the exclusive width for the fixing device can be arbitrarily set or changed in setting.

For example, the indicator 300*a* is turned to a position of the sheet width label portion indicating A4R (210 mm) as shown in (b). Then, in a state in which the fixing device 100 is mounted in the mounting portion 50 of the apparatus main assembly 1A in a predetermined manner, as shown in (c) of FIG. 9, a phase of the dial 300 is detected by a sensor 700B as a discriminating means provided in the apparatus main assembly 1A. That is, the sensor 700B discriminates the exclusive width set for the fixing device 100.

The controller 700 controls, on the basis of a discrimination result of the sensor 700B, the image forming operation of the image forming apparatus similar to that described in Embodiment 1.

Figure 10:
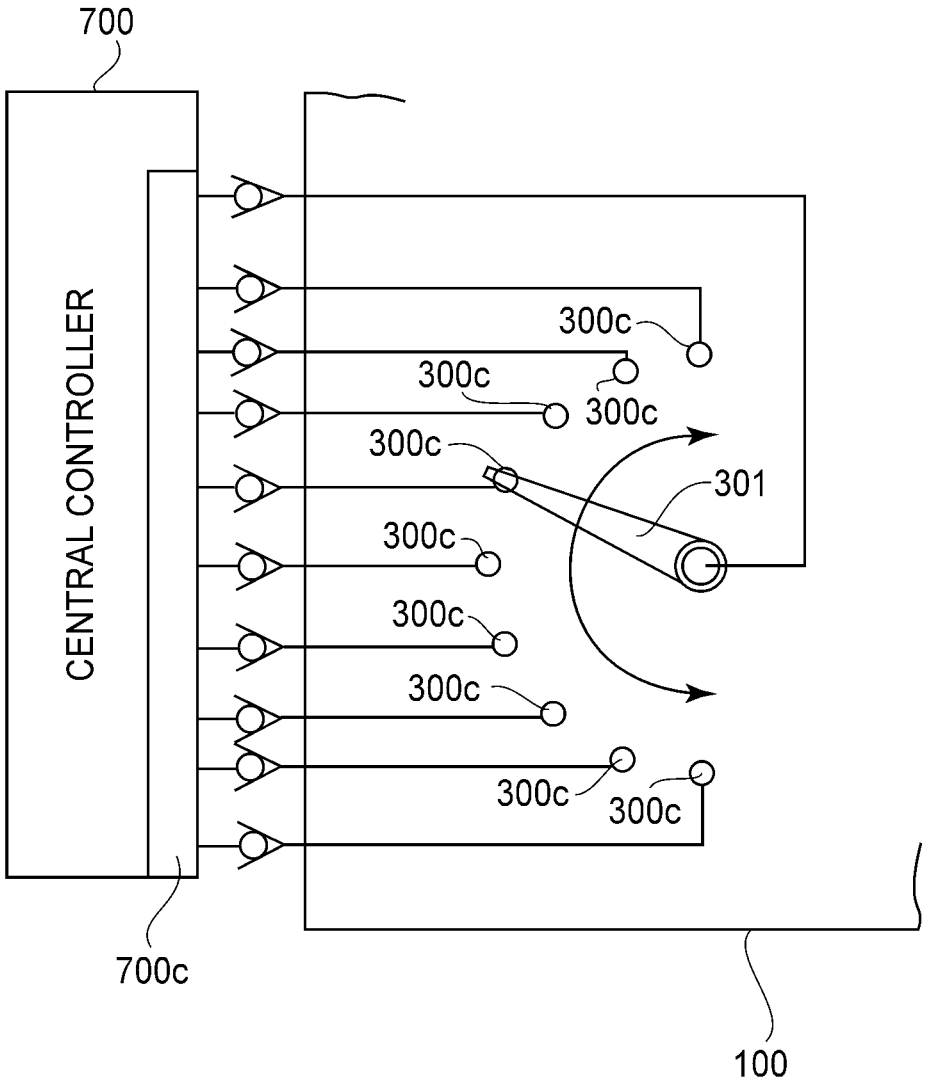
FIG. 10 is an illustration of portions other than the memory in Embodiment 3.

Further, as shown in FIG. 10, it is also possible to use an electrical switching switch (electroconductive member) 301 as an indicating portion. In this example, by turning the electrical switching switch 301 of a dial type, the switch 301 is placed in an electrical contact state with a desired electrical contact 300*c* of a plurality of electrical contacts 300*c* provided correspondingly to various exclusive widths. As a result, desired exclusive width information can be held (stored) in the fixing device 100 by setting or setting change.

In a state in which the fixing device 100 is mounted in the mounting portion 50 of the apparatus main assembly 1A in a predetermined manner, the electrical contact 300*c* electrically conducted to the switch 301 is detected by an electrical conduction detecting function portion 700B as an obtaining portion provided in the controller 700 in the apparatus main assembly 1A side. That is, the electrical conduction detecting function portion 700B discriminates the exclusive width set for the fixing device 100. The controller 700 controls, on the basis of a discrimination result of the electrical conduction detecting function portion 700B, the image forming operation of the image forming apparatus similar to that described in Embodiment 1.

As described above, Embodiments to which the present invention is applicable were described, but various constitutions can be replaced with other known constitutions within the scope of the concept of the present invention.

For example, the image forming process of the image forming apparatus 1 is not limited to the electrophotographic process (type). The image forming apparatus 1 may also be image forming apparatuses for forming an image using image forming principles or methods of other known transfer type such as electrostatic recording type or a magnetic recording type or of a direct type. Further, the image forming apparatus 1 is not limited to the color image forming apparatus, but may also be a monochromatic (single color) image forming apparatus for a monochromatic image or the like.

For example, the fixing device 100 can also have a device constitution of a belt fixing type using an endless belt having flexibility as either one or both of the fixing member 101 and the opposite member 102.

Further, the heating mechanism for the fixing member 101 and the opposite member 102 is not limited to the halogen heater. The heating mechanism can also have a device constitution employing other appropriate heating means or heating type such as a ceramic heater type or an electromagnetic induction heating type.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Applications Nos. 2014-111044 filed on May 29, 2014 and 2015-076663 filed on Apr. 3, 2015, which are hereby incorporated by reference herein in their entirety.

What is claimed is:

1. A control device configured to control an image forming apparatus capable of forming an image on a recording material, the image forming apparatus including a storing portion configured to store information corresponding to a width of a recording material and a fixing device which is replaceable with another fixing device, said control device comprising:

a reading portion configured to read the information corresponding to the width of the recording material stored in the storing portion;

an obtaining portion configured to obtain information corresponding to a width of a recording material to be subjected to an image forming operation; and a controller configured to control an operation of the image forming apparatus on the basis of the information read by said reading portion and the information obtained by said obtaining portion, wherein when the width of the recording material obtained by said obtaining portion is smaller than the width of the recording material read by said reading portion, said controller prohibits the image forming operation without replacing the fixing device.

2. A control device according to claim 1, wherein when the width of the recording material obtained by said obtaining portion is larger than the width of the recording material read by said reading portion, said controller permits the image forming operation without replacing the fixing device.

3. A control device according to claim 1, wherein when the width of the recording material obtained by said obtaining portion is the same as the width of the recording material read by said reading portion, said controller permits the image forming operation without replacing the fixing device.

4. A control device according to claim 1, wherein when the width of the recording material obtained by said obtaining portion is smaller than the width of the recording material read by said reading portion, said controller carries out a notification operation prompting replacement of the fixing device.

5. A control device according to claim 4, further comprising a display portion, wherein when the width of the recording material obtained by said obtaining portion is smaller than the width of the recording material read by said reading portion, said controller displays the notification on said display portion.

6. A control device according to claim 1, wherein when the width of the recording material obtained by said obtaining portion is larger than the width of the recording material read by said reading portion, said controller carries out a notification operation prompting selection of whether to permit execution of the image forming operation without replacement of the fixing device.

7. A control device according to claim 6, further comprising a display portion, wherein when the width of the recording material obtained by said obtaining portion is larger than the width of the of the recording material read by said reading portion, said controller displays the notification on said display portion.

8. A control device according to claim 7, wherein when the width of the recording material obtained by said obtaining portion is larger than the width of the recording material read by said reading portion, said controller displays a key for permitting execution of the image forming operation without replacement of the fixing device and a key for prohibiting execution of the image forming operation without replacement of the fixing device.

9. A control device according to claim 1, wherein the storing portion is provided on the fixing the device and is replaceable together with the fixing device.

10. A control device according to claim 9, further comprising a display portion, wherein when the width of the recording material obtained by said obtaining portion is smaller than the width of the recording material read by said reading portion, said controller controls display of said display portion to prompt replacement of the fixing device with another fixing device provided with a storing portion storing information corresponding to the width of the recording material obtained by said obtaining portion.

11. A control device according to claim 1, wherein the fixing device includes a pair of rotatable members forming a nip therebetween for fixing the image by heat and pressure.

12. A control device configured to control an image forming apparatus capable of forming an image on a recording material, the image forming apparatus including an indicating portion configured to indicate information corresponding to a width of the recording material and a fixing device which is replaceable with another fixing device, said control device comprising:

a first obtaining portion configured to obtain the information corresponding to the width of the recording material indicated by the indicating portion;

a second obtaining portion configured to obtain information corresponding to a width of a recording material to be subjected to an image forming operation; and a controller configured to control an operation of the image forming apparatus on the basis of the information obtained by said first obtaining portion and the information obtained by said second obtaining portion, wherein when the width of the recording material obtained by said second obtaining portion is smaller than the width of the recording material obtained by said first obtaining portion, said controller prohibits the image forming operation without replacing the fixing device.

13. A control device according to claim 12, wherein when the width of the recording material obtained by said second obtaining portion is larger than the width of the recording material obtained by said first obtaining portion, said controller permits the image forming operation without replacing the fixing device.

14. A control device according to claim 12, wherein when the width of the recording material obtained by said second obtaining portion is the same as the width of the recording material obtained by said first obtaining portion, said controller permits the image forming operation without replacing the fixing device.

15. A control device according to claim 12, wherein when the width of the recording material obtained by said second obtaining portion is smaller than the width of the recording material obtained by said first obtaining portion, said controller carries out a notification operation prompting replacement of the fixing device.

16. A control device according to claim 15, further comprising a display portion, wherein when the width of the recording material obtained by said second obtaining portion is smaller than the width of the recording material obtained by said first obtaining portion, said controller displays the notification on said display portion.

17. A control device according to claim 12, wherein when the width of the recording material obtained by said second obtaining portion is larger than the width of the of the recording material obtained by said first obtaining portion, said controller carries out a notification operation prompting selection of whether to permit execution of the image forming operation without replacement of the fixing device.

18. A control device according to claim 17, further comprising a display portion, wherein when the width of the recording material obtained by said second obtaining portion is larger than the width of the recording material obtained by said first obtaining portion, said controller carries out the notification on the display portion.

19. A control device according to claim 18, wherein when the width of the recording material obtained by said second obtaining portion is larger than the width of the recording material obtained by said first obtaining portion, said controller displays a key for permitting execution of the image forming operation without replacement of said fixing device and a key for prohibiting execution of the image forming operation without replacement of the fixing device.

20. A control device according to claim 12, wherein the indicating portion is provided on the fixing device and is replaceable together with the fixing device.

21. A control device according to claim 20, further comprising a display portion, wherein when the width of the recording material obtained by said second obtaining portion is smaller than the width of the recording material obtained by said first obtaining portion, said controller controls display of said display portion to prompt replacement of the fixing device with another fixing device, which is provided with an indicating portion indicating the information corresponding to the width of the recording material obtained by said second obtaining portion.

22. A control device according to claim 12, wherein the fixing device includes a pair of rotatable members forming a nip therebetween for fixing the image by heat and pressure.

23. A control device according to claim 12, wherein the indicating portion has a plurality of portions indicating different widths of the recording material and a selecting portion configured to select one of the portions, wherein said first obtaining portion obtains information corresponding to the width in accordance with the portion selected by the selecting portion.

24. A control device according to claim 23, wherein the selecting portion includes a movable indicator.

25. An image forming apparatus comprising:

an image forming device configured to form an image on a recording material;

a fixing device configured to fix the image formed on the recording material by said image forming device, said fixing device being replaceable with another fixing device;

a storing portion configured to store information corresponding to a width of the recording material;

a reading portion configured to read the information corresponding to the width of the recording material stored in said storing portion;

an obtaining portion configured to obtain information corresponding to a width of a recording material to be subjected to an image forming operation; and a controller configured to control an operation of said image forming apparatus on the basis of the information read by said reading portion and the information obtained by said obtaining portion, wherein when the width of the recording material obtained by said obtaining portion is smaller than the width of the recording material read by said reading portion, said controller prohibits the image forming operation without replacing said fixing device.

26. An image forming apparatus according to claim 25, wherein when the width of the recording material obtained by said obtaining portion is larger than the width of the recording material read by said reading portion, said controller permits the image forming operation without replacing said fixing device.

27. An image forming apparatus according to claim 25, wherein when the width of the recording material obtained by said obtaining portion is the same as the width of the recording material read by said reading portion, said controller permits the image forming operation without replacing said fixing device.

28. An image forming apparatus according to claim 25, wherein when the width of the recording material obtained by said obtaining portion is smaller than the width of the recording material read by said reading portion, said controller carries out a notification operation prompting replacement of said fixing device.

29. An image forming apparatus according to claim 28, further comprising a display portion, wherein when the width of the recording material obtained by said obtaining portion is smaller than the width of the recording material read by said reading portion, said controller displays the notification on said display portion.

30. An image forming apparatus according to claim 25, wherein when the width of the recording material obtained by said obtaining portion is larger than the width of the recording material read by said reading portion, said controller carries out a notification operation prompting selection of whether to permit execution of the image forming operation without replacement of said fixing device.

31. An image forming apparatus according to claim 30, further comprising a display portion, wherein when the width of the recording material obtained by said obtaining portion is larger than the width of the of the recording material read by said reading portion, said controller displays the notification on said display portion.

32. An image forming apparatus according to claim 31, wherein when the width of the recording material obtained by said obtaining portion is larger than the width of the recording material read by said reading portion, said controller displays a key for permitting execution of the image forming operation without replacement of said fixing device and a key for prohibiting execution of the image forming operation without replacement of said fixing device.

33. An image forming apparatus according to claim 25, wherein said storing portion is provided on said fixing device and is replaceable together with said fixing device.

34. An image forming apparatus according to claim 33, further comprising a display portion, wherein when the width of the recording material obtained by said obtaining portion is smaller than the width of the recording material read by said reading portion, said controller controls display of said display portion to prompt replacement of said fixing device with another fixing device provided with a storing portion storing information corresponding to the width of the recording material obtained by said obtaining portion.

35. An image forming apparatus according to claim 25, wherein said fixing device includes a pair of rotatable members forming a nip therebetween for fixing the image by heat and pressure.

36. An image forming apparatus comprising:

an image forming device configured to form an image on a recording material;

a fixing device configured to fix the image formed on the recording material by said image forming device, said fixing device being replaceable with another fixing device;

an indicating portion configured to indicate information corresponding to a width of the recording material;

a first obtaining portion configured to obtain the information corresponding to the width of the recording material indicated by said indicating portion;

a second obtaining portion configured to obtain information corresponding to a width of a recording material to be subjected to an image forming operation; and a controller configured to control an operation of said image forming apparatus on the basis of the information obtained by said first obtaining portion and the information obtained by said second obtaining portion, wherein when the width of the recording material obtained by said second obtaining portion is smaller than the width of the recording material obtained by said first obtaining portion, said controller prohibits the image forming operation without replacing said fixing device.

37. An image forming apparatus according to claim 36, wherein when the width of the recording material obtained by said second obtaining portion is larger than the width of the recording material obtained by said first obtaining portion, said controller permits the image forming operation without replacing said fixing device.

38. An image forming apparatus according to claim 36, wherein when the width of the recording material obtained by said second obtaining portion is the same as the width of the recording material obtained by said first obtaining portion, said controller permits the image forming operation without replacing said fixing device.

39. An image forming apparatus according to claim 36, wherein when the width of the recording material obtained by said second obtaining portion is smaller than the width of the recording material obtained by said first obtaining portion, said controller carries out a notification operation prompting replacement of said fixing device.

40. An image forming apparatus according to claim 39, further comprising a display portion, wherein the width of the recording material obtained by said second obtaining portion is smaller than the width is of the recording material obtained by said first obtaining portion, said controller displays the notification on said display portion.

41. An image forming apparatus according to claim 36, wherein when the width of the recording material obtained by said second obtaining portion is larger than the width of the of the recording material obtained by said first obtaining portion, said controller carries out a notification operation prompting selection of whether to permit execution of the image forming operation without replacement of said fixing device.

42. An image forming apparatus according to claim 41, further comprising a display portion, wherein when the width of the recording material obtained by said second obtaining portion is larger than the width of the recording material obtained by said first obtaining portion, said controller carries out the notification on said display portion.

43. An image forming apparatus according to claim 42, wherein when the width of the recording material obtained by said second obtaining portion is larger than the width of the recording material obtained by said first obtaining portion, said controller displays a key for permitting execution of the image forming operation without replacement of said fixing device and a key for prohibiting execution of the image forming operation without replacement of said fixing device.

44. An image forming apparatus according to claim 36, wherein said indicating portion is provided on said fixing device and is replaceable together with said fixing device.

45. An image forming apparatus according to claim 44, further comprising a display portion, wherein when the width of the recording material obtained by said second obtaining portion is smaller than the width of the recording material obtained by said first obtaining portion, said controller controls display of said display portion to prompt replacement of said fixing device with another fixing device, which is provided with an indicating portion indicating the information corresponding to the width of the recording material obtained by said second obtaining portion.

46. An image forming apparatus according to claim 36, wherein said fixing device includes a pair of rotatable members forming a nip therebetween for fixing the image by heat and pressure.

47. An image forming apparatus according to claim 36, wherein said indicating portion has a plurality of portions indicating different widths of the recording material and a selecting portion configured to select one of the portions, wherein said first obtaining portion obtains information corresponding to the width in accordance with the portion selected by said selecting portion.

48. An image forming apparatus according to claim 47, wherein said selecting portion includes a movable indicator.

49. A control device for controlling a display operation for an image forming operation of an image forming apparatus capable of forming an image on a recording material, said control device being capable of controlling a display portion for displaying a choice selectable by an operator, the image forming apparatus including a storing portion configured to store information corresponding to a width of the recording material and a fixing device which is replaceable with another fixing device, said control device comprising:

a reading portion configured to read the information corresponding to the width of the recording material stored in the storing portion and relating to the fixing device installed in the image forming apparatus; and a display control portion configured to control the display portion to disable a selection of the width of the recording material to be subjected to the image forming operation smaller than the width of the recording material read by said reading portion or to permit a selection of the width of the recording material to be subjected to the image forming operation not smaller than the width of the recording material read by said reading portion.

50. A control device according to claim 49, wherein the storing portion is provided on the fixing the device and is replaceable together with the fixing device.

51. A control device according to claim 49, wherein the fixing device includes a pair of rotatable members forming a nip therebetween for fixing the image by heat and pressure.

52. A control device for controlling a display operation for an image forming operation of an image forming apparatus capable of forming an image on a recording material, said control device being capable of controlling a display portion for displaying a choice selectable by an operator, the image forming apparatus including an indicating portion configured to indicate information corresponding to a width of the recording material and a fixing device which is replaceable with another fixing device, said control device comprising:

an obtaining portion configured to obtain the information corresponding to the width of the recording material indicated by the indicating portion and relating to the fixing device installed in the image forming apparatus; and a display control portion configured to control the display portion to disable a selection of the width of the recording material to be subjected to the image forming operation smaller than the width of the recording material obtained by said obtaining portion and permit a selection of the width of the recording material to be subjected to the image forming operation not smaller than the width of the recording material obtained by said obtaining portion.

53. A control device according to claim 52, wherein the indicating portion is provided on the fixing the device and is replaceable together with the fixing device.

54. A control device according to claim 52, wherein the fixing device includes a pair of rotatable members forming a nip therebetween for fixing the image by heat and pressure.

55. A control device according to claim 52, wherein the indicating portion has a plurality of portions indicating different widths of the recording material and a selecting portion configured to select one of the portions, wherein said obtaining portion obtains information corresponding to the width in accordance with the portion selected by the selecting portion.

56. A control device according to claim 55, wherein the selecting portion includes a movable indicator.

57. An image forming apparatus comprising:

a display portion to perform a display;

an image forming device configured to form an image on a recording material;

a fixing device configured to fix the image formed on the recording material by said image forming device, said fixing device being replaceable with another fixing device;

a storing portion configured to store information corresponding to a width of the recording material;

a reading portion configured to read the information corresponding to the width of the recording material stored in said storing portion and relating to said fixing device mounted in said image forming apparatus; and a display control portion configured to control said display portion for displaying a choice selectable by an operator, wherein said display control portion is configured to disable a selection of the width of the recording material to be subjected to an image forming operation smaller than the width of the recording material read by said reading portion or permit a selection of the width of the recording material to be subjected to the image forming operation not smaller than the width of the recording material read by said reading portion.

58. An image forming apparatus according to claim 57, wherein said storing portion is provided on said fixing device and is replaceable together with said fixing device.

59. An image forming apparatus according to claim 57, wherein said fixing device includes a pair of rotatable members forming a nip therebetween for fixing the image by heat and pressure.

60. An image forming apparatus comprising:

a display portion to perform a display;

an image forming device configured to form an image on a recording material;

a fixing device configured to fix the image formed on the recording material by said image forming device, said fixing device being replaceable with another fixing device;

an indicating portion configured to indicate information corresponding to a width of the recording material;

an obtaining portion configured to obtain the information corresponding to the width of the recording material indicated by said indicating portion and relating to said fixing device mounted in said image forming apparatus; and a display control portion configured to control said display portion for displaying a choice selectable by an operator, wherein said display control portion is configured to disable a selection of the width of the recording material to be subjected to an image forming operation smaller than the width of the recording material obtained by said obtaining portion or permit a selection of the width of the recording material to be subjected to the image forming operation not smaller than the width of the recording material obtained by said obtaining portion.

61. An image forming apparatus according to claim 60, wherein said indicating portion is provided on said fixing device and is replaceable together with said fixing device.

62. An image forming apparatus according to claim 60, wherein said fixing device includes a pair of rotatable members forming a nip therebetween for fixing the image by heat and pressure.

63. An image forming apparatus according to claim 60, wherein said indicating portion has a plurality of portions indicating different widths of the recording material and a selecting portion configured to select one of the portions, wherein said obtaining portion obtains information corresponding to the width in accordance with the portion selected by said selecting portion.

64. An image forming apparatus according to claim 63, wherein said selecting portion includes a movable indicator.

65. An image forming apparatus comprising:

a display portion to perform a display;

an image forming device configured to form an image on a recording material;

a fixing device configured to fix the image formed on the recording material by said image forming device and comprising a storing portion configured to store information corresponding to a width of the recording material, said fixing device being replaceable with another fixing device;

a reading portion configured to read the information corresponding to the width of the recording material stored in said storing portion; and a display control portion configured to control said display portion for displaying choice selectable by an operator, wherein said display control portion is configured to disable a selection of the width of the recording material to be subjected to an image forming operation smaller than the width of the recording material read by said reading portion or permit a selection of the width of the recording material to be subjected to the image forming operation equal to the width of the recording material read by said reading portion.

* * * * *